United States Patent [19]

Harvey

[11] Patent Number: 4,649,687

[45] Date of Patent: Mar. 17, 1987

[54] REFRACTORY STRUCTURE AND METHOD

[75] Inventor: Erie M. Harvey, Greensboro, N.C.

[73] Assignee: Resco Products, Inc., Norristown, Pa.

[21] Appl. No.: 330,982

[22] Filed: Dec. 15, 1981

Related U.S. Application Data

[63] Continuation of Ser. No. 159,468, Jun. 6, 1980, abandoned, which is a continuation of Ser. No. 744,492, Nov. 24, 1976, abandoned, which is a continuation of Ser. No. 196,831, Nov. 8, 1971, abandoned, which is a continuation of Ser. No. 67,282, Aug. 26, 1970, abandoned, which is a continuation of Ser. No. 837,965, Mar. 19, 1969, abandoned, which is a continuation of Ser. No. 635,828, May 3, 1967, abandoned.

[51] Int. Cl.[4] ..... E04C 2/04; E04B 1/02

[52] U.S. Cl. ..... 52/596; 52/378; 52/509; 52/513; 52/515; 52/747; 264/30; 501/94; 501/127; 501/128

[58] Field of Search ..... 52/378, 379, 509, 513, 52/232, 747, 596; 264/30; 501/94, 127, 128

[56] References Cited

U.S. PATENT DOCUMENTS

| | | | |
|---|---|---|---|
| Re. 18,298 | 12/1931 | Straub . | |
| 185,221 | 12/1876 | Dunning | 264/30 |
| 1,515,375 | 11/1924 | Tone | 52/747 |
| 1,973,434 | 9/1934 | Harvey et al. | 106/68 |
| 1,978,077 | 10/1934 | Doyle et al. | 52/379 |
| 1,983,590 | 12/1934 | Anderson | 52/232 X |
| 2,120,133 | 6/1938 | Kohler | 52/483 X |
| 2,240,117 | 4/1941 | Homolaya | 52/378 X |
| 2,336,949 | 12/1943 | Mortimer | 25/155 |
| 2,363,522 | 11/1944 | Greaves-Waker et al. | 106/68 |
| 2,462,289 | 2/1949 | Rochow | 72/37 |
| 2,543,548 | 2/1951 | Henry et al. | 106/67 |
| 2,637,890 | 5/1953 | Ramsay | 106/68 X |
| 2,657,651 | 11/1953 | Forsyth | 110/99 |
| 2,713,787 | 7/1955 | Rose | 72/37 |
| 2,901,990 | 11/1959 | Hutter | 110/99 |
| 2,968,083 | 1/1961 | Lentz et al. | 25/155.5 |
| 3,079,267 | 2/1963 | Konrad et al. | 106/64 |
| 3,146,115 | 8/1964 | Wishon et al. | 106/67 |
| 3,197,315 | 7/1965 | Jacobs | 106/65 |
| 3,197,930 | 8/1965 | Kimmlinger et al. | 52/378 |
| 3,228,084 | 1/1966 | Coleman | 25/142 |
| 3,233,015 | 2/1966 | Davies | 264/30 |
| 3,295,280 | 1/1967 | Kettner | 52/378 |
| 3,368,670 | 2/1968 | Weaver | 206/65 |
| 3,414,419 | 2/1968 | Farrington | 106/58 |
| 3,606,722 | 9/1971 | Fitzpatrick | 52/747 |

FOREIGN PATENT DOCUMENTS

| | | |
|---|---|---|
| 927382 | 5/1963 | United Kingdom . |

*Primary Examiner*—Alfred C. Perham

*Attorney, Agent, or Firm*—Seidel, Gonda, Goldhammer & Abbott

[57] ABSTRACT

A high temperature resistant refractory mortarless joint wall and method made from pre-formed, unburned plastic refractory blocks having siliceous clay, and from ten percent to seventy-five percent pyrophyllite, by weight, and workability from twenty percent to forty percent when erected before drying and firing.

10 Claims, 4 Drawing Figures

REFRACTORY STRUCTURE AND METHOD

CROSS REFERENCE TO RELATED APPLICATIONS

The application is a continuation of copending application Ser. No. 159,468, filed June 16, 1980, now abandoned, which was a continuation of application Ser. No. 744,492 filed Nov. 24, 1976, now abandoned; which was a continuation of Ser. No. 196,831, filed Nov. 8, 1971, now abandoned; which was a continuation of Ser. No. 067,282, filed Aug. 26, 1970, now abandoned, which was a continuation of Ser. No. 837,965, filed Mar. 19, 1969, now abandoned; and which was a continuation of Ser. No. 635,828, filed May 3, 1967, now abandoned.

BACKGROUND OF THE INVENTION

Refractory walls used in high temperature furnaces, soaking pits and other applications in steel mills and elsewhere are constructed in various ways in order to provide the desired high temperature resistance required for the particular application and installation. Presently high temperature resistant refractory walls used in furnaces and soaking pits utilize a mixture of crushed raw pyrophyllite, generally of the massive-type, with plastic clay in various compositions to form a monolithic wall. Highly skilled brick masons and other skilled artisans are required to erect a refractory wall gradually increasing the elevation, in sections, by hammering, ramming or compressing, manually with pneumatic hammers, the plastic clay and pyrophyllite "slices" to form a dense and compact wall structure. Erection of a wall must be formed by continuously adding and building, through hammering, ramming or compressing, additional plastic clay and pyrophyllite to form the dense refractory monolithic wall construction. This long established procedure is tedious, time consuming and costly. In addition, the density and refractory characteristics of a wall constructed in this manner may vary considerably from one part to another depending upon the skill of the craftsman. Refractory walls in soaking pits, for example, are subjected periodically to damage caused by impact from an ingot when placed in or withdrawn from the soaking pit. Cracks and other damage to a wall require periodic repairs. The time and extent for making the repairs will depend upon the damage, and repairs may be made by spraying the damaged portion while the soaking pit is at elevated temperatures, but when the damage is extensive, the soaking pit must be permitted to cool sufficiently to enable entrance and access to the damaged area that may necessitate removal of a section and installation of new portions by hammering, ramming or compressing additional material into the damaged area. Suitable plastic mixes containing pyrophyllite may be paddled on the damaged area of the wall when the soaking pit is cooled sufficiently. However, all of the present procedures are extremely costly and time consuming as well as require skilled artisans that are difficult to obtain.

OBJECTS OF THE INVENTION

It is one of the main objectives of this invention to utilize pre-formed plastic blocks of predetermined dimensions having a desired mixture including pyrophyllite, massive or foliated types, and positioning such blocks to form a refractory wall eliminating the conventional ramming, hammering and compressing or compacting of relatively small slices of pyrophyllite-contained refractory materials to form a substantially monolithic wall.

A further objective of this invention is to form an homogeneous refractory wall for soaking pits and other high temperature applications in which substantially massive plastic blocks containing a mixture of clay and pyrophyllite are employed and supported in side-by-side and vertically stacked relationship to present a vertical refractory wall preferably without the use of any mortar or adhesive placed between the stacked plastic blocks thereby substantially reducing the time and cost of installation of the wall.

Still another objective is to provide a method for forming a refractory wall utilizing plastic blocks made from a mixture including a broad range of pyrophyllite in which minimum shrinkage or slump will occur in the constructed wall during erection and before exposure to high temperatures and whereby the plastic blocks are sufficiently workable to trowel the surface exposed to the high temperature to seal or close exposed joints between the plastic blocks without adding additional mortar.

Still another objective is to provide a refractory wall and method of forming such wall in which a series of stacked plastic blocks containing a mixture of pyrophyllite and clay is used without the use of any extraneous mortar between the plastic blocks and applying a coating of refractory material, including preferably pyrophyllite, as a surfacing that may be sprayed, paddled or otherwise applied against the plastic blocks on at least the surface of the wall exposed to high temperature.

An additional important feature of this invention resides in the provision of a high temperature refractory wall in which plastic blocks are stacked with each of the blocks being made from a mixture of high fusion temperature materials that contain pyrophyllite with each of the blocks retaining sufficient workability due to the water content retained therein whereby mechanical water may be driven off at approximately 250 degrees F. and the block expands upon being subjected to high temperatures preventing voids or spaces upon expansion of the pyrophyllite. The refractory wall formed by utilizing the plastic blocks achieves the benefits of pyrophyllite that is capable of withstanding more heat shock with higher resistance to softening which will occur only generally at the fusion point with more cycles of heating and cooling than clay refractories. The blocks may be readily handled and positioned to form a substantially monolithic refractory wall without the necessity of working each individual block with adjacent blocks by the conventional ramming, hammering and compressing of one block into another block to form the wall.

Other objectives and advantages of this invention will become more readily apparent to those skilled in the refractory art upon considering the following detailed description taken in conjunction with the accompanying drawing in which like characters of reference designate corresponding parts throughout the several views.

DESCRIPTION OF PREFERRED EMBODIMENTS

Figure 1:
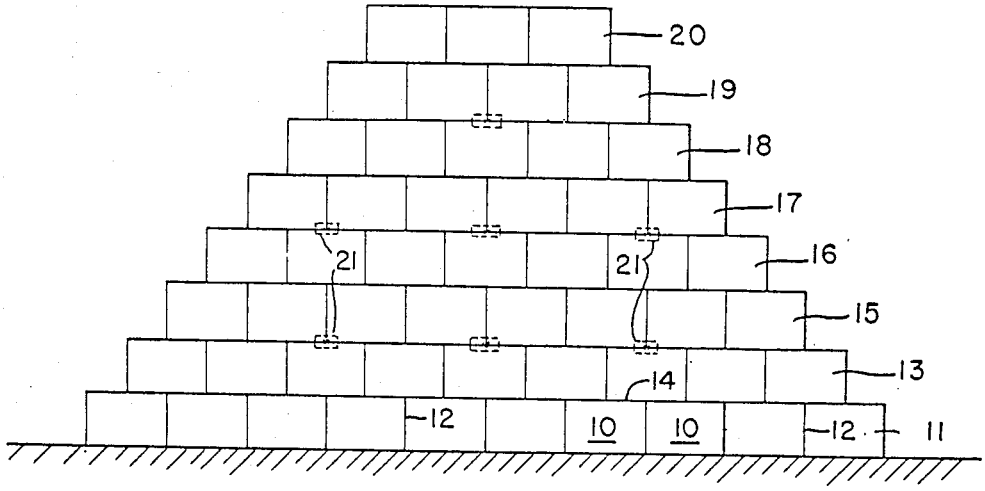
FIG. 1 is a front elevational view of a portion of a refractory wall illustrating a plurality of plastic blocks stacked side-by-side and vertically to form a unitary refractory wall.
Figure 2:
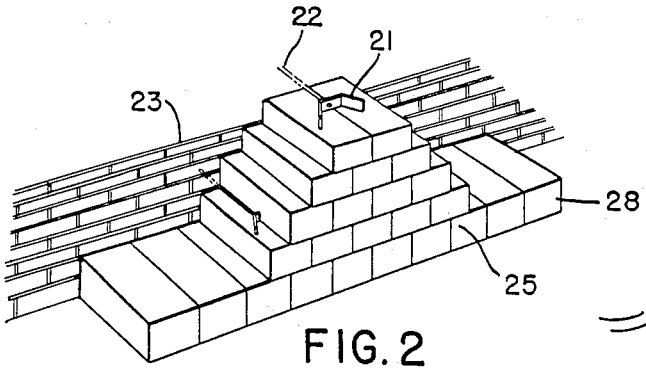
FIG. 2 is a front partial perspective view of a refractory wall illustrating partial horizontal rows and staggered superimposed layers of plastic blocks positioned adjacent to a back-up brick wall to which anchoring members are secured.

Pyrophyllite has been recognized as an excellent refractory material mined as a crystalline mineral coming within the rhombic or monoclinic system. Chemically, pyrophyllite is a hydrous alumina silicate and its chemical formulation is: $Al_2O_34SiO_2M_2O$. For the present invention, massive-type or foliated-type pyrophyllite may be utilized but the massive-type pyrophyllite is preferred.

The following tables are illustrative of the physical properties and chemical analyses of the plastic blocks of the refractory walls made in accordance with this invention, however, such physical properties and chemical analyses are not intended by way of limitation, and are illustrative only:

TABLE I

| | |
|---|---|
| Pyrometric Cone Equivalent | Cone 29–31 (3040° F.) |
| Hot Load Test at 2460° F. on Samples Previously Heated to 2500° F. | 0.5% |
| Panel Spalling Test, 2910° F. | 3.1% |
| Preheat, Avg. Loss, 14 Brick | |
| Workability | 33.0% |
| Moisture (% dry weight) | 10.2% |
| Permanent Linear Change (% Plastic Length) + Expansion - Shrinkage: | |
| 230° F. | −1.5% |
| 1800° F. | −1.0% |
| 2550° F. | −0.6% |
| 2700° F. | −0.1% |
| Modulus of Rupture: | |
| 230° F. | 202 psi |
| 1800° F. | 106 psi |
| 2550° F. | 475 psi |
| 2700° F. | 514 psi |

| Screen Analysis (wet %) | | Chemical Analysis | |
|---|---|---|---|
| 8 | 17.2 | $SiO_2$ | 64.90% |
| 10 | 11.2 | $Al_2O_3$ | 27.89% |
| 20 | 14.0 | $Fe_2O_3$ | 1.07% |
| 48 | 6.4 | $TiO_2$ | .81% |
| 65 | 2.2 | CaO | .14% |
| 100 | 2.2 | MgO | .09% |
| −100 | 44.8 | $K_2O$ | .13% |
| Total | 100.00 | L.O.I. | 4.90% |
| | | Total | 100.12% |

TABLE II

| | |
|---|---|
| Pyrometric Cone Equivalent | 32½ |
| Hot Load Test at 2640° F. on Material Which Had Been Previously Heated at 2500° F. - Avg. | 0.4% |
| Panel Spalling Test | 1.2% |

TABLE II-continued

| | |
|---|---|
| Preheat 3000° F. | |
| Workability | 32.0% |
| Moisture | 12.6% |
| Permanent Linear Change (% Plastic Length) + Expansion - Shrinkage: | |
| 230° F. | −1.3% |
| 1800° F. | −1.0% |
| 2550° F. | −0.1% |
| 2700° F. | −0.1% |

| Screen Analysis (wet %) | | Chemical Analysis | |
|---|---|---|---|
| 8 | 16.0 | $SiO_2$ | 55.54% |
| 10 | 7.2 | $Al_2O_3$ | 37.00% |
| 20 | 12.0 | $Fe_2O_3$ | 1.50% |
| 48 | 9.6 | $TiO_2$ | 0.75% |
| 65 | 2.0 | CaO | .16% |
| 100 | 1.8 | MgO | .14% |
| −100 | 51.4 | $K_2O$ | .21% |
| Total | 100.0 | L.O.I. | 4.40% |
| | | Total | 100.00% |

The plastic blocks 10 are extruded in a continuous ribbon initially and then cut to the desired length. In one particular and desirable application, the individual block dimensions are: 5⅞ inches high, 8⅞ inches wide, and 17 inches long. It has been determined that for the plastic blocks of the dimensions noted that the weight per cubic foot is approximately 148 pounds, and the weight per square foot for the 17 inch depth of the plastic block is 209 pounds. It will be obvious that the actual dimensions of the plastic blocks may vary depending upon the specific application and temperature requirements taking into account the rates of heat transfer as well as the insulating characteristics of the materials that are utilized to back-up or be placed behind the refractory wall.

As will be noted in FIG. 1, the individual plastic blocks 10 are positioned closely adjacent to each other, in side-by-side contiguous relationship, in the bottom row 11 forming therebetween vertical joints or lines 12. The next row 13 of plastic blocks 10 is positioned in staggered relation to the bottom row 11 forming the horizontal joint line 14. Additional rows 15 through 20, preferably but not necessarily, may continue the staggered relation for positioning of the individual blocks 10. At suitable intervals, anchoring members 21 are positioned to be embedded into the plastic blocks. There is sufficient workability in the blocks 10 to permit the anchoring members 21 to be compressed into the block during installation with the anchor rod 22 being suitably secured to the back-up or retaining wall 23. Wall 23 is illustrated as a brick wall and no mineral wool insulation blocks may be required. However, it is preferred practice when steel back-up wall may be employed, a two-inch mineral wool block insulation may be placed between the steel wall and the refractory wall. Additionally, end expansion joints of mineral wool insulation may be utilized, when desirable.

It has been observed than in the erection of one wall that was 11 feet, ⅝ inches in height, there was an overall vertical shrinkage over a period of approximately ten days of 1⅜ inches spanning a total of approximately 211 hours after the wall was installed and before firing.

Figure 3:
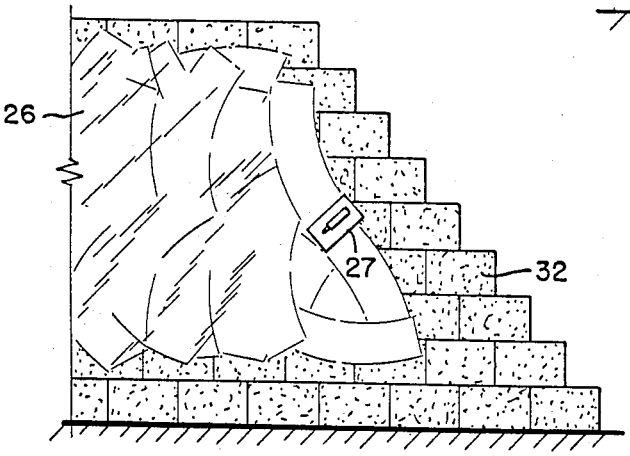
FIG. 3 is a partial front view illustrating a refractory wall made with stacked rows of plastic blocks in which the mortarless joints are covered or sealed by troweling the exposed surface which is sufficiently plastic upon installation or by applying an additional surface coating of a plastic refractory having a suitable composition, preferably including pyrophyllite.

In order to retain adequate moisture for the desired range of workability in the plastic blocks, each block or a number of blocks is packaged, shipped and stored after being wrapped in a polyethylene bag. The feature of workability is significant particularly in the event the exposed surface 25 of the wall is to be further worked as by troweling or smoothing as shown in FIG. 3 so as to form the surface 26 in which the individual joints or lines 12 and 14 that are formed between adjacent blocks and rows of blocks may be covered to present a uniform monolithic appearance for the entire wall surface exposed to the high temperature. Installation of several refractory walls made in accordance with this invention have revealed that it is not necessary to provide mortar between the joints. A hand trowel 27 may be used, or other suitable tool, depending upon the workability of the exposed surfaces 28 of each of the blocks 10. It has been determined that after suitable troweling of the exposed ends 28 of the blocks 10, a very uniform overall appearance will be achieved making it virtually imperceptible to discern the individual plastic blocks.

In those refractory walls where it is desirable to provide an additional coating, a suitable highly siliceous mineral base having a grain size suitable for spraying or paddling may be utilized. This gun mix or a paddling mix of the following physical properties and chemical analysis may be used:

TABLE III

| | |
|---|---|
| Pyrometric Cone Equivalent | 27–29 |
| Temperature | 3000° F. |
| Hot Load Deformation @ 2500° F. | 1.39% |
| Workability | Excellent |
| Shootability | Excellent |
| Water of Plasticity | 12.2% |
| Permanent Linear Change (% Plastic Length) + Expansion - Shrinkage | |
| 230° F. | −0.75% |
| 1800° F. | −0.35% |
| 2550° F. | +0.60% |
| 2700° F. | +0.40% |
| Modulus of Rupture | |
| 230° F. | 196 PSI |
| 1800° F. | 132 PSI |
| 2550° F. | 645 PSI |
| 2700° F. | 719 PSI |

| Sieve Analysis | | | Chemical Analysis | |
|---|---|---|---|---|
| Screen | % Dry | % Wet | | |
| 8 | 14.2% | 14.4% | SiO | 67.40% |
| 10 | 15.1% | 14.5% | $Al_2O_3$ | 27.16% |
| 20 | 18.5% | 17.4% | $Fe_2O_3$ | .84% |
| 48 | 15.2% | 12.0% | CaO | .08% |
| 65 | 4.9% | 3.1% | MgO | .04% |
| 100 | 6.5% | 3.1% | $K_2O$ | .20% |
| −100 | 25.6% | 35.5% | $Na_2O$ | .24% |
| Total | 100.0% | 100.0% | L.O.I. | 4.10% |
| | | | Total | 100.06% |

Figure 4:
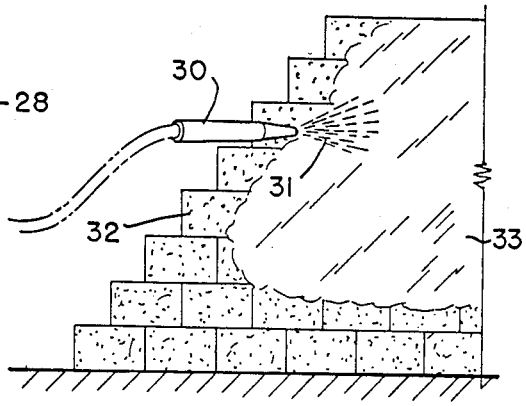
FIG. 4 is illustrative of a modified refractory wall in which the plastic blocks are stacked substantially as shown in FIGS. 1 and 2 with the surface exposed to the high temperature being sprayed with a suitable gun mix refractory preferably containing pyrophyllite.

As is illustrated in FIG. 4, the gun discharge nozzle 30 will discharge the plastic refractory mix in a spray 31 against the exposed surface 32 of the plastic block refractory wall. The depth or thickness of the coating 33 on the wall will depend upon the specific or particular application to which the wall will be utilized. It will be readily apparent that repairs may be made quite readily to refractory walls constructed in accordance with this invention where damage has been caused to any particular section. Depending upon the extent of damage, portions of the wall may be repaired either by ramming a suitable mix in the damaged area when the refractory wall and surrounding area have been cooled sufficiently. It is possible that some blocks may be removed, depending upon the location, and new blocks inserted to repair the damaged area. In the event that cracks appear in the wall, the damaged area may be sprayed with a suitable repairing mixture.

The plastic blocks 10 may be made from a mixture of siliceous clay, and pyrophyllite having a range from 10 percent to 75 percent, by weight. The blocks should have a range of moisture by percent of dry weight in the range of from 8 to 15 percent, with the blocks having a workability, in accordance with ASTM standards, in the range of from 20 percent to 40 percent in the erection or installation of the wall.

I claim:

1. In a method of forming a high temperature refractory wall for furnaces, soaking pits and the like including the steps of applying preformed, unburned, moisture-containing, plastic refractory shapes directly against each other in the absence of mortar in an adjacent relationship and heating the shapes to form the wall, the improvement comprising using massive plastic refractory blocks as the shapes, maintaining the individual integrity and shape of each of the blocks without at any time ramming, hammering or compressing the blocks during the positioning thereof and the formation of the wall, and maintaining the individual integrity and shape of each of the blocks during the heating thereof and during and after the formation of the wall.

2. A method according to claim 1 including heat the positioned blocks to a temperature sufficient to expand them in situ from their original, undisturbed preformed integral condition while removing moisture therefrom and reducing spaces and voids between adjacent blocks.

3. A method according to claim 1 wherein the blocks have a workability of between about 20 percent and about 40 percent and a moisture content by percent of dry weight of between about 8 percent and about 15 percent.

4. A refractory wall formed by the method of claims 1, 2 or 3.

5. A method according to claim 1, wherein the blocks are rectangular solids whose sides are in the ratio of approximately 3:1.5:1.

6. A method according to claim 5, wherein the shortest side of the block is approximately six inches.

7. In a method of forming a high temperature refractory wall for furnaces, soaking pits and the like including the steps of applying preformed, unburned, moisture-containing, plastic refractory shapes directly against each other in the absence of mortar in an adjacent relationship and heating the shapes to form the wall, the improvement comprising using as said shapes massive plastic refractory blocks which are rectangular solids, maintaining the individual integrity and shape of each of the blocks without at any time ramming, hammering or compressing the blocks during the positioning thereof and the formation of the wall, heating the positioned blocks to a temperature sufficient to expand them in situ from their original, undisturbed preformed integral condition while removing moisture therefrom and reducing spaces and voids between adjacent blocks, and maintaining the individual integrity and shape of each of the blocks during the heating thereof and during and after the formation of the wall.

8. A method according to claim 7, wherein the sides of the blocks are in the ratio of approximately 3:1.5:1.

9. A method according to claims 1 or 7, including placing anchoring means in the wall at predetermined intervals and securing the anchoring means to a reinforcing wall.

10. A method according to claims 1 or 7, wherein the blocks comprise siliceous clay plus a pyrophyllite content between about 10 percent by weight and about 75 percent by weight.

* * * * *